US008429876B2

(12) United States Patent
Aburto

(10) Patent No.: US 8,429,876 B2
(45) Date of Patent: Apr. 30, 2013

(54) CONCRETE RIB CONSTRUCTION METHOD

(76) Inventor: Eugenio Santiago Aburto, Palm Desert, CA (US)

( * ) Notice: Subject to any disclaimer, the term of this patent is extended or adjusted under 35 U.S.C. 154(b) by 345 days.

(21) Appl. No.: 12/583,952

(22) Filed: Aug. 27, 2009

(65) Prior Publication Data

US 2011/0047928 A1 Mar. 3, 2011

(51) Int. Cl.

| | |
|---|---|
| ***E04B 2/84*** | (2006.01) |
| ***E04B 5/32*** | (2006.01) |
| ***E04B 5/36*** | (2006.01) |
| ***E04B 5/38*** | (2006.01) |

(52) U.S. Cl.

USPC ..... 52/742.14; 52/236.5; 52/251; 52/295; 52/320; 52/378; 52/405.1; 264/35

(58) Field of Classification Search ..... 52/236.5, 52/250, 251, 295, 319, 320, 378, 405.1, 742.15, 52/742.154; 264/35

See application file for complete search history.

(56) References Cited

U.S. PATENT DOCUMENTS

| | | | | | |
|---|---|---|---|---|---|
| 694,577 | A | * | 3/1902 | Ransome | 264/34 |
| 716,628 | A | * | 12/1902 | Dickey | 52/332 |
| 1,559,749 | A | * | 11/1925 | Hall | 52/374 |
| 1,773,168 | A | * | 8/1930 | Brostrom | 52/332 |
| 1,834,892 | A | * | 12/1931 | Betzler | 52/284 |
| 2,154,390 | A | * | 4/1939 | Akers | 52/371 |
| 2,202,745 | A | * | 5/1940 | Muse | 52/285.2 |
| RE21,905 | E | * | 9/1941 | Neilsen | 52/206 |
| 2,337,743 | A | * | 12/1943 | Deuel | 52/94 |
| 2,356,138 | A | * | 8/1944 | Widmayer | 52/441 |
| 2,592,634 | A | * | 4/1952 | Wilson | 52/584.1 |
| 3,490,729 | A | * | 1/1970 | Hiller et al. | 249/27 |
| 3,630,479 | A | * | 12/1971 | Sullivan | 249/19 |
| 3,775,922 | A | * | 12/1973 | Myers | 52/367 |
| 3,779,523 | A | * | 12/1973 | Furlong et al. | 261/111 |
| 3,847,521 | A | * | 11/1974 | Stickler, Jr. | 425/62 |
| 3,917,765 | A | * | 11/1975 | Furlong et al. | 261/111 |
| 3,919,824 | A | * | 11/1975 | Davis, Jr. | 52/689 |
| 4,291,513 | A | * | 9/1981 | Ankarswed | 52/284 |
| 4,422,997 | A | * | 12/1983 | Machnik | 264/261 |
| 4,573,303 | A | * | 3/1986 | Figari | 52/742.14 |
| 4,759,160 | A | * | 7/1988 | Fischer | 52/91.2 |
| 4,811,770 | A | * | 3/1989 | Rapp | 52/309.12 |
| 4,841,702 | A | * | 6/1989 | Huettemann | 52/309.12 |
| 4,841,703 | A | * | 6/1989 | Grimaud | 52/334 |
| 5,313,753 | A | * | 5/1994 | Sanger | 52/251 |
| 5,381,635 | A | * | 1/1995 | Sanger | 52/251 |
| 5,930,965 | A | * | 8/1999 | Carver | 52/320 |
| 6,003,278 | A | * | 12/1999 | Weaver et al. | 52/414 |
| 6,141,929 | A | * | 11/2000 | Kistner et al. | 52/302.3 |

(Continued)

*Primary Examiner* — Robert Canfield
(74) *Attorney, Agent, or Firm* — Sanjesh Prabha Sharma

(57) ABSTRACT

A system for constructing building consisting of connected T-beams for walls and roof. To create the T shape the system uses blocks of rigid insulation as forming, which are embedded in the poured-in-place concrete. These blocks serve to insulate the structure. The final structure is a monolithic box where the foundation, (101, 102), and (103) is the lower face, walls are the vertical faces of the box, attached to the foundation by dowels (104) to the walls reinforcement part (105) and the roof (118, 119, 120), and (121) is the top. This results in a sturdy structure with integrated high insulation (111) and (122) in walls and roof. Metal nailers (123) with the polystyrene foam strips (124) can be embedded in the ends of the T-beam stems. These nailers ease the insertion of screws to wall and ceiling interiors, allowing the building interior to be finished with gypsum board or paneling.

17 Claims, 12 Drawing Sheets

U.S. PATENT DOCUMENTS 6,427,406 B1 * 8/2002 Weaver et al. ..... 52/414
6,463,702 B1 * 10/2002 Weaver et al. ..... 52/79.1
6,494,004 B1 * 12/2002 Zimmerman ..... 52/251
6,691,470 B2 * 2/2004 Sanger ..... 52/127.2
7,530,203 B1 * 5/2009 Hare et al. ..... 52/251
7,627,997 B2 * 12/2009 Messenger et al. ..... 52/309.17
7,900,410 B2 * 3/2011 Skendzic et al. ..... 52/251
7,958,687 B2 * 6/2011 Dilorenzo ..... 52/319
8,015,771 B2 * 9/2011 LeBlang ..... 52/414
2005/0155297 A1 * 7/2005 Aburto Ponce ..... 52/79.1
2011/0047928 A1 * 3/2011 Aburto ..... 52/745.05

* cited by examiner

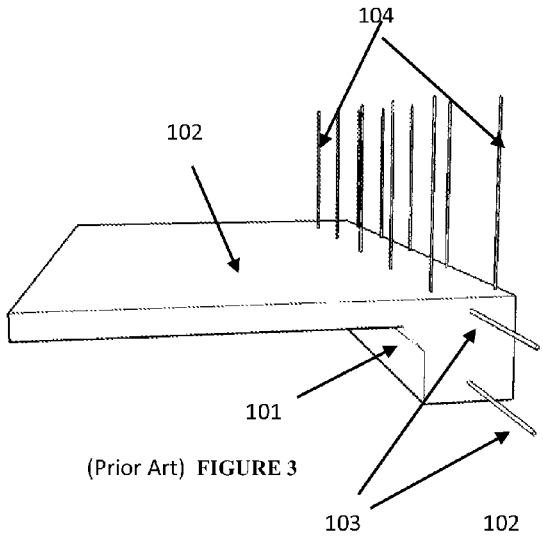
(Prior Art) FIGURE 3
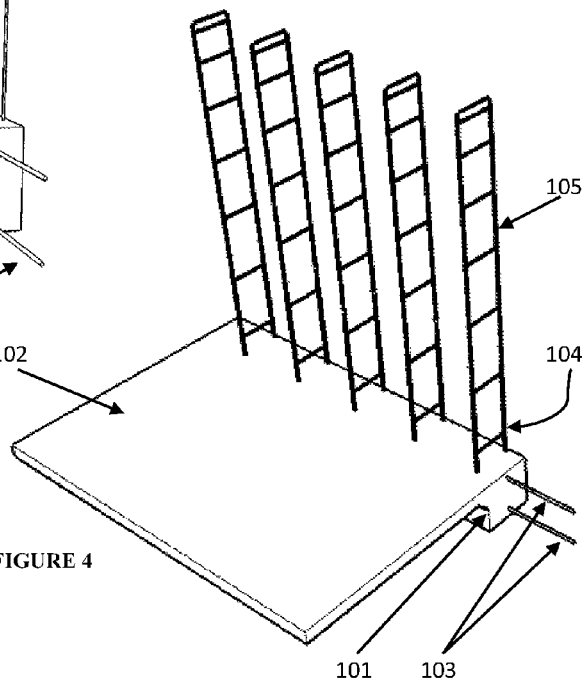
FIGURE 4
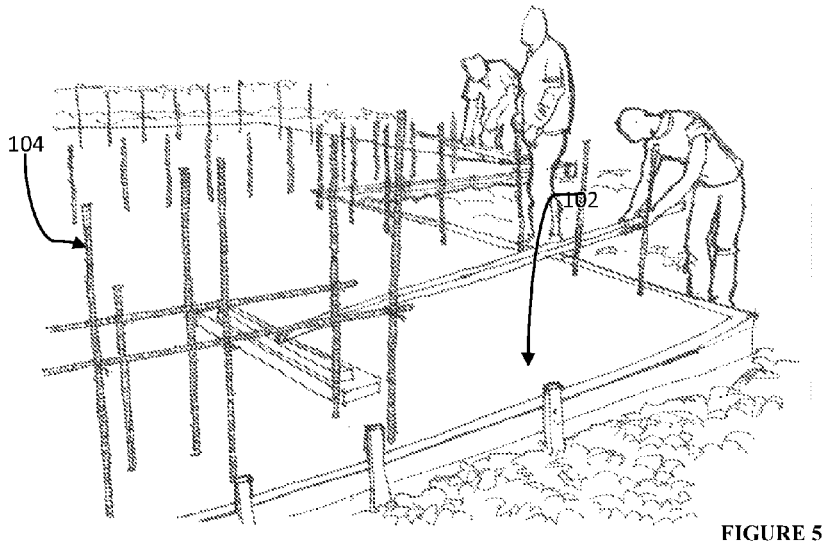
FIGURE 5

FIGURE 19
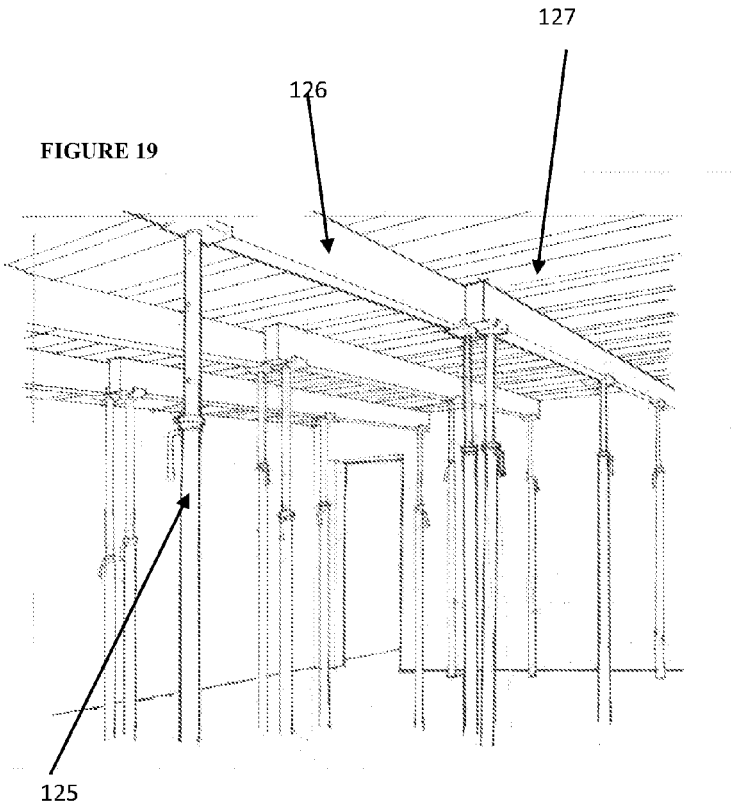
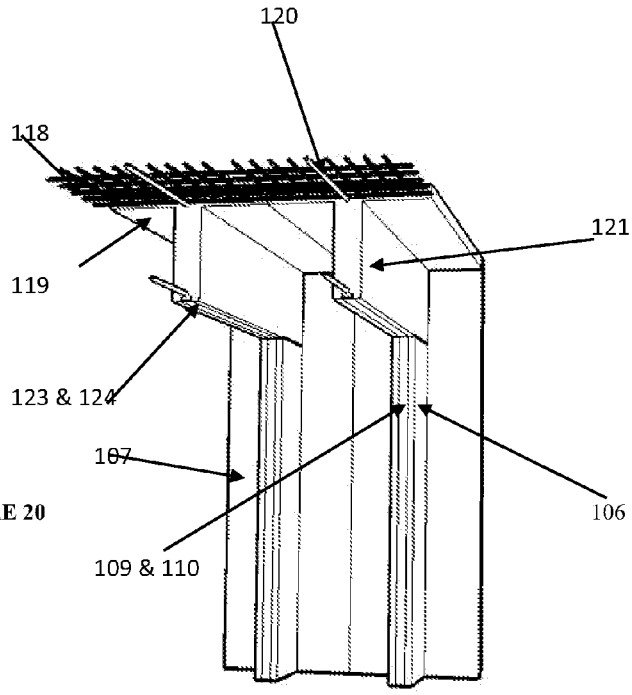
FIGURE 20

FIGURE 21
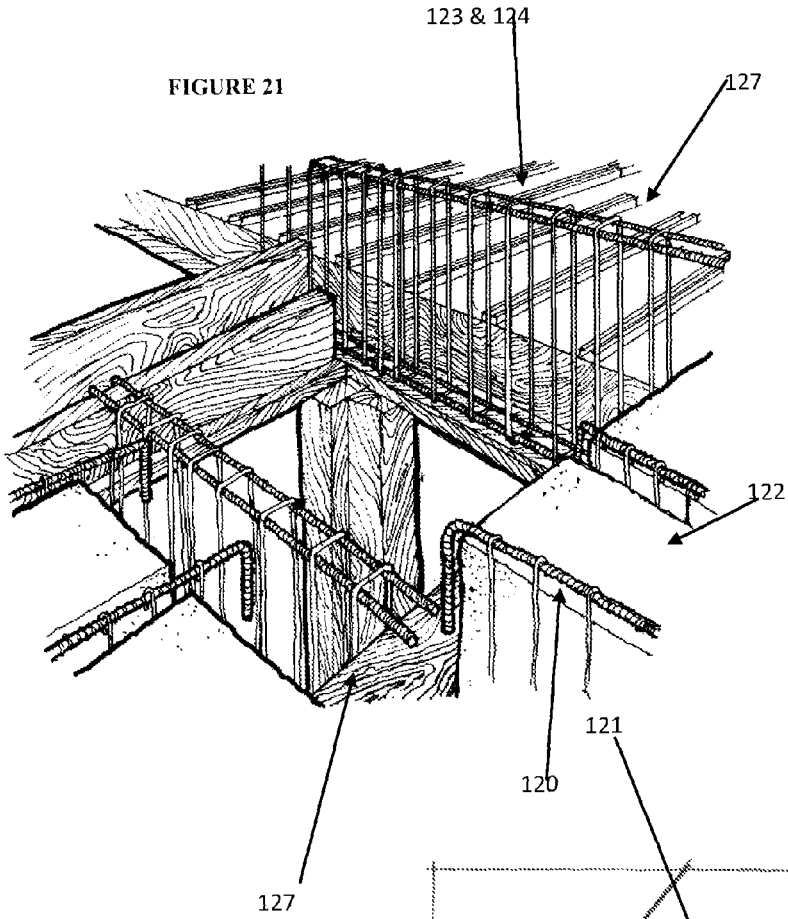
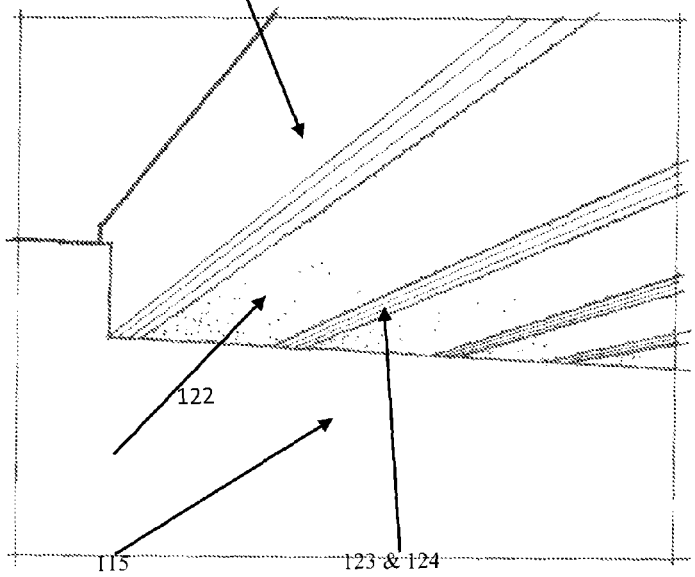
FIGURE 22

CONCRETE RIB CONSTRUCTION METHOD

FEDERALLY SPONSORED RESEARCH

Not applicable.

SEQUENCE LISTING OR PROGRAM

Not applicable.

BACKGROUND OF THE INVENTION

1. Field of Invention

This system is an improved method of constructing concrete buildings, using T beams for walls and roof thereby creating a very strong monolithic structure highly resistant to natural disasters. Rigid foam insulation is integrated into the forms, producing an energy efficient building: strength and efficiency with a minimal quantity of concrete.

2. Prior Art

Masonry construction has been used for dwelling starting with improving caves and followed by multiple methods and construction materials, as written below:

(a) Ancient Masonry Wall Construction

Masonry wall construction is a very old building practice; used throughout the world. Typically various mortars were used to unite individual small units such as stones, into a large building resulting in strong walls. Materials depended on availability; for example, on the Greek island of Thera (known as Santorini) the mortar used was the local volcanic soil. Imperial Roman builders, with the availability of volcanic sand with cementing properties, crafted a mortar to cast thick and high masonry walls using natural stone. These walls were formed of two external planes of laid stone, then filled with rubble and mortar. Buildings constructed in this way, such as the coliseum, have stood for millennia. This system was possible because slavery was legal in ancient Rome; a titanic and inexpensive labor force was available for handling such heavy duties. A similar construction system was used in the building of multi-story structures at Chaco Canyon; N. Mex., in the fourteenth century uniting stones with a mortar of soil. As an expensive, labor-intensive process the present use of masonry walls in the U.S. is more for decoration than for convenience.

(b) Conventional Masonry Unit Construction.

Typical modern masonry construction uses concrete blocks, clay bricks or stone masonry units to build walls. This requires skilled labor and supervision. After the walls have been built, electrical and plumbing elements are installed by scoring channels in the masonry resulting in a blemish that must later be patched. The exterior perimeter needs to be caulked and maintained.

(c) Prefabricated Concrete Panels.

Prefabricated panels made of light weight concrete are factory built and assembled on site. To assemble a building using prefabricated elements requires skilled labor, administration, logistics, and planning. It also requires a factory, specialized machinery, technical personnel, and a market absorbing the planned production. Panels require warehouse space, and transport with clerical work involved. Panel construction relies on a metal frame for strength, and does not achieve a monolithic condition.

(d) Concrete Poured-in-Place Systems.

There are several systems using poured-in-place concrete, mainly for wall construction. There are companies selling or renting forming equipment made of steel, aluminum, or fiberglass. For economy such walls are thin, typically 4 inches in dimension. Such walls, as a result of temperature changes or soils reactions, develop cracks. There are also several systems on the market (generally known as "insulated concrete forms") using specially shaped polystyrene which are stacked like bricks, then reinforced with rebar placed in the voids provided by the system. The voids of the forms are then filled with concrete, and the exterior is covered with stucco. The polystyrene covered with stucco is relatively weak; woodpeckers have pecked holes in such walls to store their nuts. Normally the roof is built by the use of wood or metal beams, rafters, or trusses, which strong winds lift, leaving the walls with no bracing.

There are some systems which have walls and flat roofs of reinforced concrete. They are popular to satisfy the demand of very affordable dwellings, but are rarely used in the United States. Such buildings, as a result of temperature changes or soils reactions, develop cracks which require heavy maintenance, such as caulking and some times patching or rebuilding.

(e) Tilt Up Concrete System.

Another construction system very popular is producing concrete panels on site, usually for industrial buildings. Such panels are poured flat on the floor slab and subsequently raised to a vertical position by a crane. The wall's thickness and steel reinforcement must be calculated to withstand the strain of lifting. The assembling requires tow equipment and specially skilled labor.

(f) Eugenio Aburto Poured-in-Place System Using Rock Filled Concrete Walls and Concrete T-Beam Roof.

I developed a system in Mexico City about forty years ago, the subject of a previous patent application (Ser. No. 10/760, 335 dated Jan. 20, 2004). I built several thousands of dwellings using poured-in-place concrete and rocks, creating solid masonry walls. Structural calculations designed them strong enough to resist the frequent earthquakes in that region. Roofs were a concrete slab based on the principle of T-beams; concrete hollow blocks were used as form work to generate the T shape. The system was successful to produce affordable dwellings, schools and commercial buildings. They are still standing, enjoyed by their occupants during more than 40 years as a proof of the efficiency of the system.

OBJECTS AND ADVANTAGES

The object of the concrete rib construction system is to use standard, readily available materials (concrete, rigid foam and forms) to create structures that are extremely strong and energy efficient using a minimum of material. The structure is strong because it is composed of concrete T-beams. These interconnect walls and roof into a monolithic box. The rigid insulation, which is part of the forming process, is embedded in the concrete, thereby providing energy efficiency.

The system provides great strength. The construction system has walls and roof built of T-beams, connecting their ribs of walls with the ribs of roofs, forming a rigid frame. Walls are anchored to the foundation. Groups of ribs, by design, are positioned in a direction 90 degrees from one another. Together the walls, roof and foundation form a monolithic box capable of resisting stresses from natural forces such as earthquakes, hurricanes and tornadoes. Unlike unit masonry structures, panels and tilt-up buildings, the concrete becomes a single unit. This monolith contrasts with previous forms of masonry construction which rely on structural elements such as wood or metal to connect the concrete segments. A typical element of the concrete rib system is 2 to 4 inches in thickness, whereas a typical dimension in other systems is at least 5½ inches. The concrete rib system achieves greater strength with less material.

Insulation is an integral part of the concrete rib system. As will be shown, the rigid foam used to form the T-beams becomes embedded in the concrete and thus provides insulation for the finished structure. With no voids or leaks, the system is energy efficient. Unlike "insulated concrete forms", the exterior of the concrete rib system is a solid concrete wall providing greater protection for the inhabitants. Thickness of the walls can be varied to incorporate any desired level of insulation, depending on the climate where the structure is located.

The system is adaptable and flexible. Concrete and rigid foam are widely available. Forms can be made of wood, metal or any rigid, moisture-resistant substance. The concrete is typically provided in the US by trucks from a mixer plant. However it can also be produced on site by a small mixer or in extreme conditions produced by hand and shovels. A team of unskilled workers can build a concrete rib structure with simple instructions. The concrete rib system doesn't require specialized equipment other than panels for the form work. Thus the system is suitable for use in undeveloped countries.

The concrete rib system also gives several advantages for disaster resistance. Because there are no exposed voids, in the exterior envelope, there is no way for embers to enter during a catastrophic fire. Since the principal materials are waterproof, flood damage is also minimized. Flooding rusts metal fasteners and warps the lumber of wood framing systems. Water also rusts metal framing and damages the structure. The use of concrete and rigid insulation made of expanded polystyrene makes the system water repellent and therefore suitable for flood zones.

Further advantages of the concrete rib construction system will became apparent from the following drawings and detailed description.

SUMMARY

The concrete rib construction system, by its use of T-beams, achieves greater strength with less concrete than other systems. Incorporating rigid foam insulation into the "T" beams results in an efficient forming process and an energy efficient structure. The structure is resistant to many types of natural disasters.

BRIEF DESCRIPTION OF DRAWINGS

FIG. 3 shows portion of a typical foundation with dowels to connect with wall stems.

FIG. 4 is a portion of the foundation with walls reinforcement.

FIG. 5 is an illustration of the actual work of foundation and floor slab.

FIG. 19 is an illustration of the form work used to build the roof.

FIG. 20 illustrates the roof T-beam stems matching the wall T-beam stems.

FIG. 21 is an illustration of the actual process of roof construction prior to pouring the cement, showing steel reinforcement between rigid foam insulation blocks and wood forming.

FIG. 22 is a drawing of a portion of the roof after pouring of cement and removal of forms, showing the metal channels embedded in the T-beam stems that function as nailers to hold drywall panels or any other furring material for the ceiling.

DETAILED DESCRIPTION OF THE PREFERRED EMBODIMENTS

Figure 1:
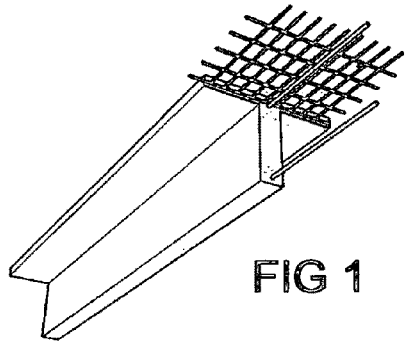
FIG. 1 shows the T-beam shape on which the system is based.

101. Reinforced concrete footing, as typically used in conventional construction.

102. Concrete floor slab, similar as is used in frame construction.

103. Steel re-bar reinforcement of footing.

104. Dowels, which are steel re-bars embedded in the concrete footing (101) to hold the stem (rib) reinforcement. Note that dowels extend generally two to three feet above the floor slab.

105. Steel re-bars with stirrups, reinforcement of ribs (stems) of the walls. These are attached to the dowels.

106. Rib (stem) of the T-beam, concrete section plus its steel reinforcement. This part of the wall works at compression stress mainly, but is structurally calculated by flexion and shear stresses when forces of nature are in action.

107. Flange with steel reinforcement of the T-beam wall, which works as a diaphragm plate for shear stress and also works as a unit with the stem.

108. Welded wire mesh, steel reinforcement of the flange on wall T-beams.

109. Bent metal part embedded in the short face of the rib (stem) of the T-beam wall to provide for nailing interior furring which can be gypsum boards or paneling.

110. Strip of rigid foam used inside part 9 to have a soft void for attaching screws to hold the furring of the interior of walls.

111. Rigid foam block used to form the T-beam wall and provide insulation.

112. Panels of plywood, fiberglass, aluminum, or recycled plastic used as form work, held in the required position by commercial concrete ties (113).

113. Commercially produced steel separator which ties two sides of the form and keeps them at the appropriate distance.

114. Steel reinforcement for exterior load bearing concrete flat wall: vertical rebar attached at dowels (104) and horizontal re-bars. Distances between vertical and horizontal re-bars are determined by structural calculations.

115. Reinforced concrete flat wall on exterior non-livable areas. Includes reinforcement rebars (114).

116. Steel reinforcement for interior load bearing concrete flat wall: vertical re-bars attached at dowels (104) and horizontal re-bars. Distances between vertical and horizontal rebars is determined by structural calculations.

117. Reinforced concrete flat wall on interior areas. Includes reinforcement rebars (116).

118. Welded wire mesh reinforcement of flange of T-beam for roof

119. Concrete slab flange of T-beam for roof. Includes reinforcement (118).

120. Horizontal rebars connected by stirrups (vertical steel rods) to reinforce stem of T-beam roof.

121. T-beam roof stem, including reinforcement (120).

122. Rigid foam block used as forming for the T-beam roof.

123. Bent metal used as flirting channels embedded in the stem ends for attaching gypsum board wall and ceiling surfaces.

124. Strip of rigid foam used inside metal channel (123) to have a soft void for attaching screws to hold the furring of the interior of walls.

125. Commercially available adjustable post shoring.

126. Beams (wood or metal) resting on shoring posts to carry forms (127).

127. Wood boards, bent metal boards, or adjustable trusses to form bottom of roof stems and support rigid foam (122) and furring channels (123 and 124) during pouring of concrete.

DETAILED DESCRIPTION

Preferred Embodiment

The concrete rib construction system is based on the use of the T-beam as a structural element for walls and roof. T-beams are commonly used in spans for parking structures, industrial roofs, bridges or similar structures. The novelty of the concrete rib system is the use of T-beams for both walls and roof, interconnecting these beams to form a monolithic box. Additionally, the system uses rigid foam insulation as part of the forming process. The foam is embedded in the concrete, thereby providing energy efficiency.

A T-beam is composed of two elements: the stem and the flange. FIG. 1 shows a basic T-beam in a horizontal position as would be used for a roof. In cross section, the vertical element of the "T" is the stem, and the horizontal element of the "T" is the flange. The concrete rib construction system, by its use of T-beams, achieves greater strength with less concrete than rectangular beams. Using rigid foam insulation to form the "T" beams results in an efficient concrete forming process as well as an energy efficient structure.

Figure 2:
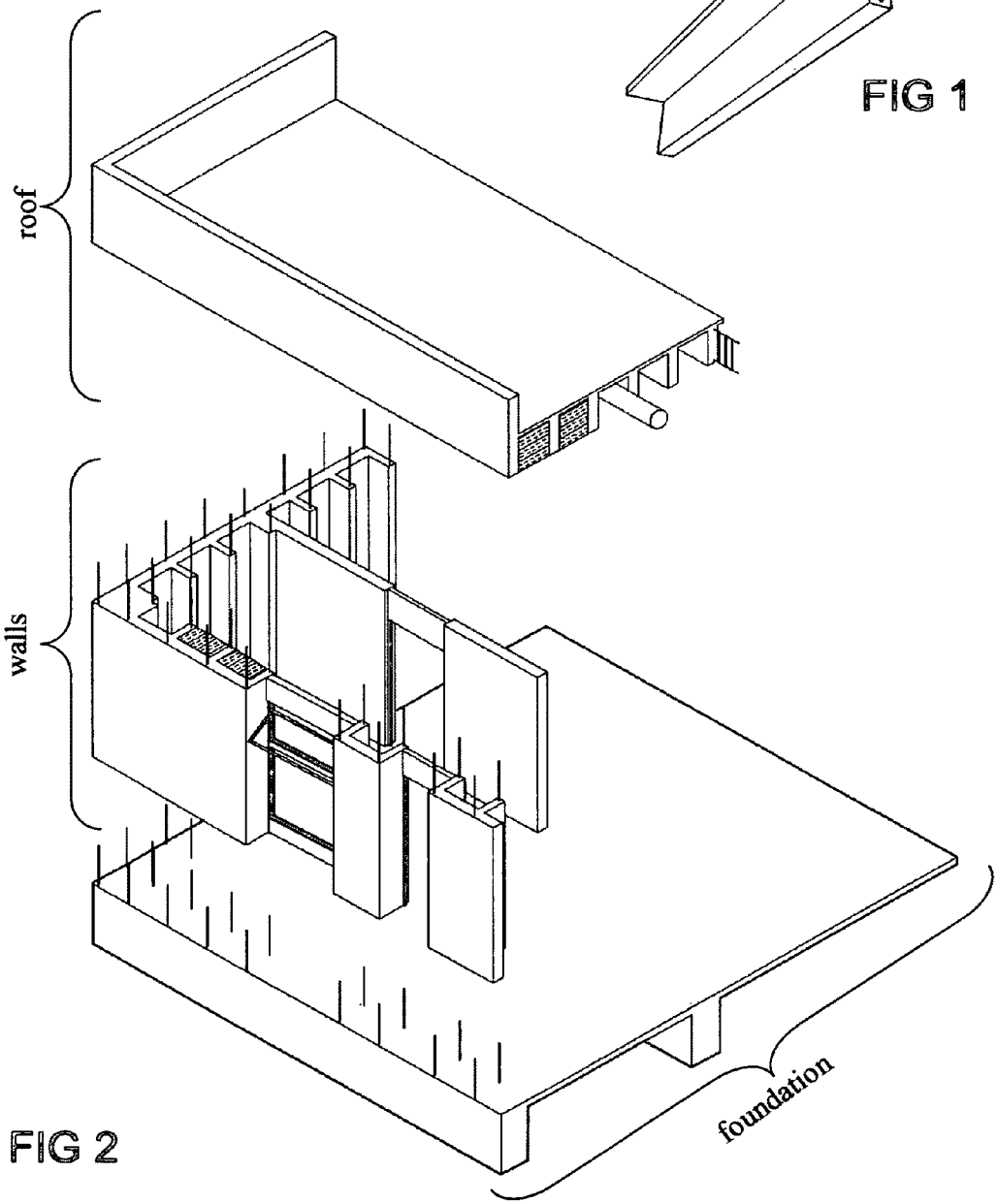
FIG. 2 is an exploded overview of part of a house built with the concrete rib system.

FIG. 2 is an exploded overview of part of a house built with the concrete rib system. The foundation and slab, seen at bottom, are similar to conventional construction. The T-beam form of walls and roof is visible. Window and door frames are set into the walls after pouring of concrete. Also visible are several blocks of rigid foam insulation (in the two roof sections closest to the viewer and the two sections to the left of the window). Although all the T-beams would incorporate such insulation, it has been shown only in a few sections to provide a clear view of the T-beam shape.

The description below follows the process of constructing a building from the ground up. Building the footings and foundation slab is like the conventional method for a wood, masonry or steel frame house which starts by grading and compaction of the building pad to accommodate the necessary footprint area. Waste lines will be placed as required. Plumbing and electrical lines are encased in the floor slab with vertical extensions where shown in the architectural construction drawings. This process is not shown in the drawings because it is part of the prior art and is a well-known procedure.

FIGS. 3, 4 and 5 illustrates the foundation and method of connecting the foundation and walls. FIG. 3, which is labeled Prior Art, shows a portion of a typical foundation. As is customary for traditional construction, the footing 101 will have the dimensions and reinforcement 103 required by structural calculations. The floor slab 102 is also typical. The innovation is the insertion of steel dowels 104 at distances required by the position of wall stems or reinforcement of flat walls. FIG. 4 is a portion of the foundation with the parts 101, 102, 103, and 104. The diagram includes the steel rebar wall reinforcement 105 required for the T-beam stems. FIG. 5 is a photograph of the actual foundation work showing the floor slab 102 and the dowels 104 inserted in the footings.

Figure 6:
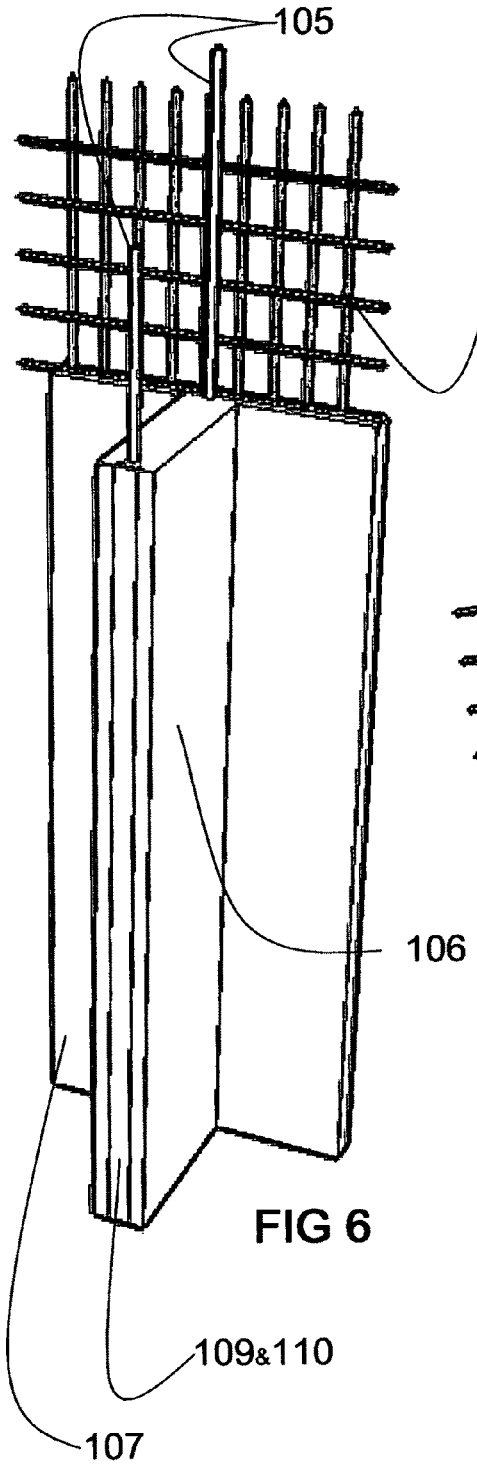
FIG. 6 shows a single T-beam wall unit.
Figure 7:
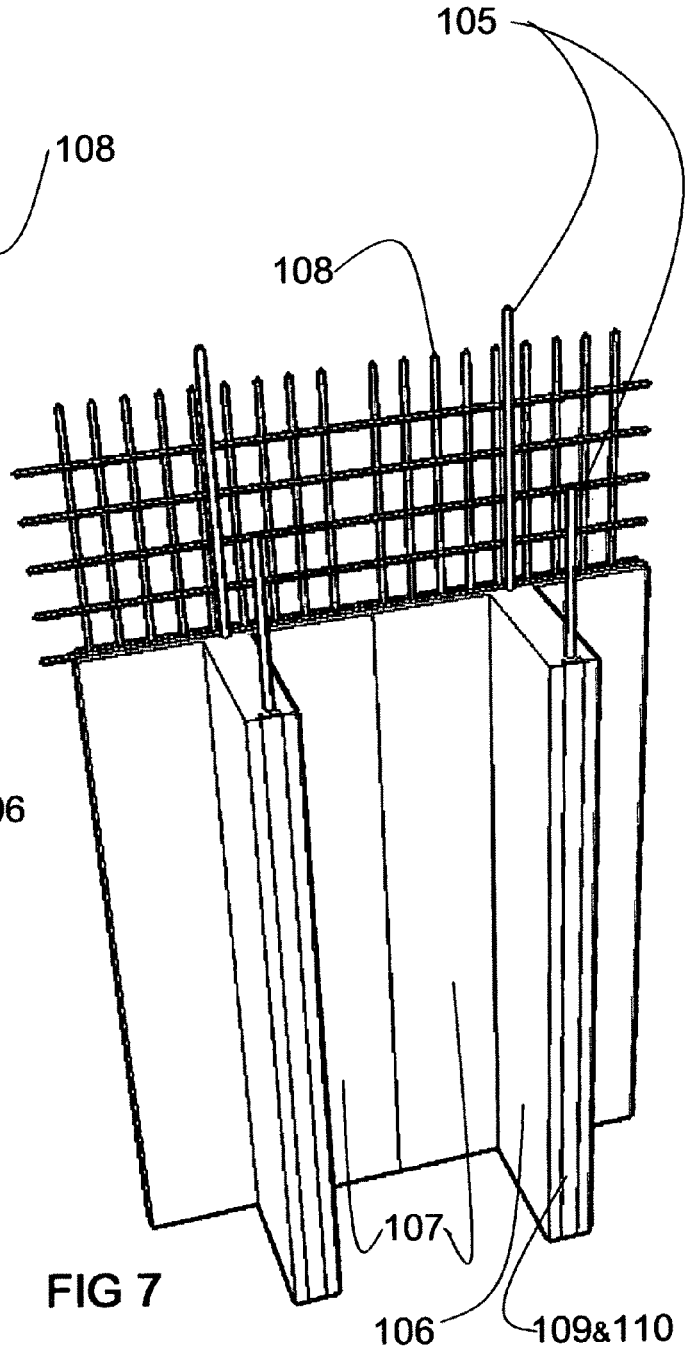
FIG. 7 shows two T-beam wall segments together.
Figure 8:
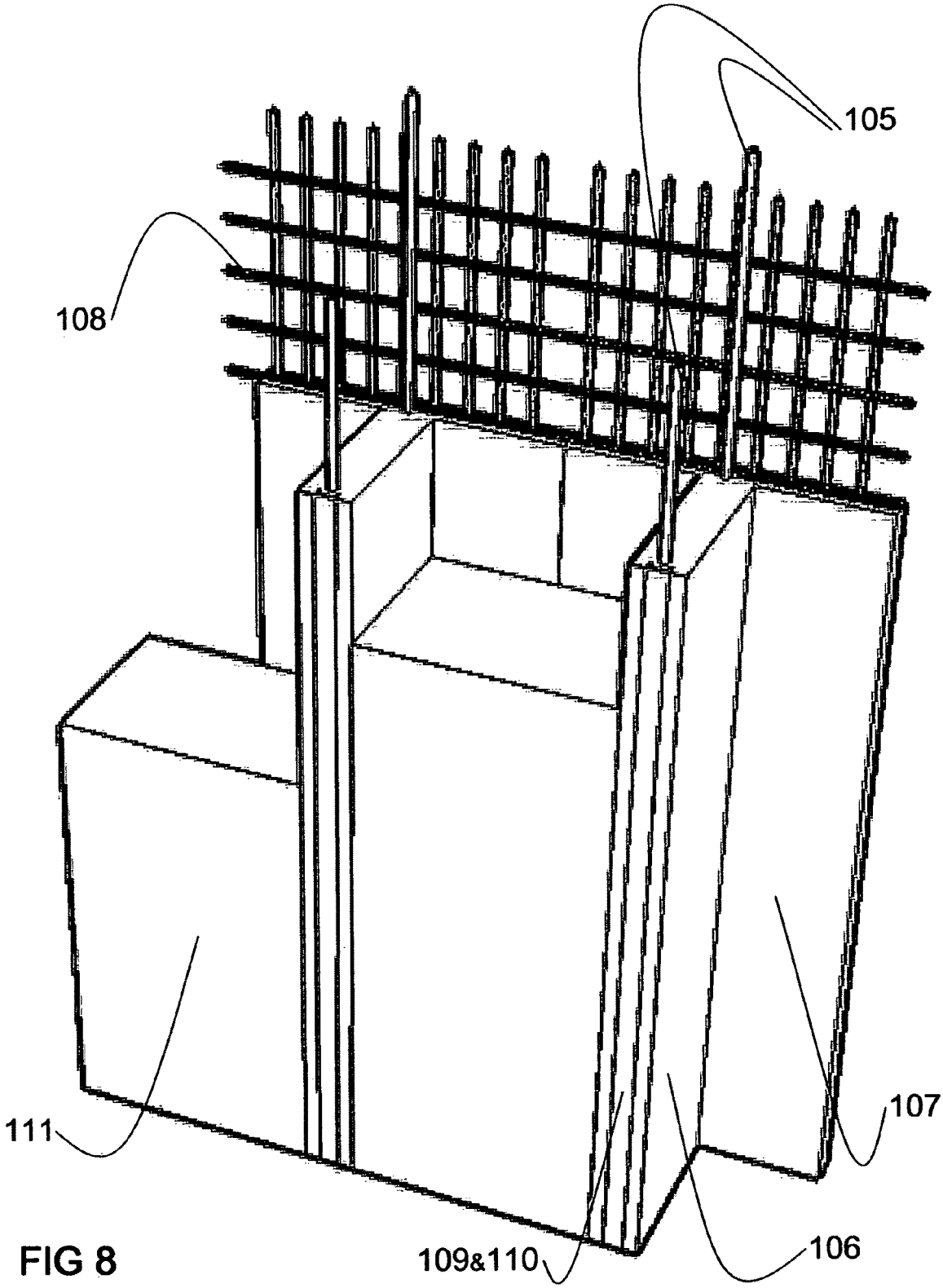
FIG. 8—shows the two T-beam wall segments with the rigid insulation in place.

FIGS. 6 and 7 illustrates the T-beams used as walls. FIG. 6 shows a single T-beam wall segment where 106 is the stem and 107 is the flange, which completes the T-shape. I named the T-beam "rib" because it functions like the ribs of the human body which protect important organs. Embedded in the face of the stem are metal channels 109 and 110, which are elements used to attach or screw in the gypsum board panels to achieve the traditional gypsum board interior wall surface preferred in the American market. The use of T-beams in a vertical arrangement is a novel characteristic of the present invention. In one embodiment of the invention, such vertical T-beams are used to build exterior perimeter walls of livable areas. The vertical stem element of the T-beam wall when joined to the stems of the roof T-beam, creates a rigid frame, making a very sturdy structure. FIG. 7 shows two T-beam wall segments together to show how parts (107) join in the same plane. The stems 106 are sides of an alcove occupied by the rigid insulation as also shown in FIG. 8. The wall T-beams in FIGS. 6, 7, and 8 show the reinforcement of the stems with steel rebars 105 and the flange reinforcement 108. Note that in practice, the flanges become a continuous plane when the concrete is poured in. Besides providing protection against fire, this continuous flange works as a diaphragm to absorb stress from earthquakes as well as from forces of wind.

FIG. 8 shows the two T-beam walls with all the parts depicted previously 105, 106, 107, 108, 109, and 110 plus the rigid insulation 111 which has a double function in serving as form work and allowing energy savings. The use of rigid insulation as forming is another novelty of an embodiment of the present invention, which improves the construction speed, avoiding the need for special construction of wood forming to generate the T-shape, and also making the envelope of the building highly energy-efficient.

Figure 9:
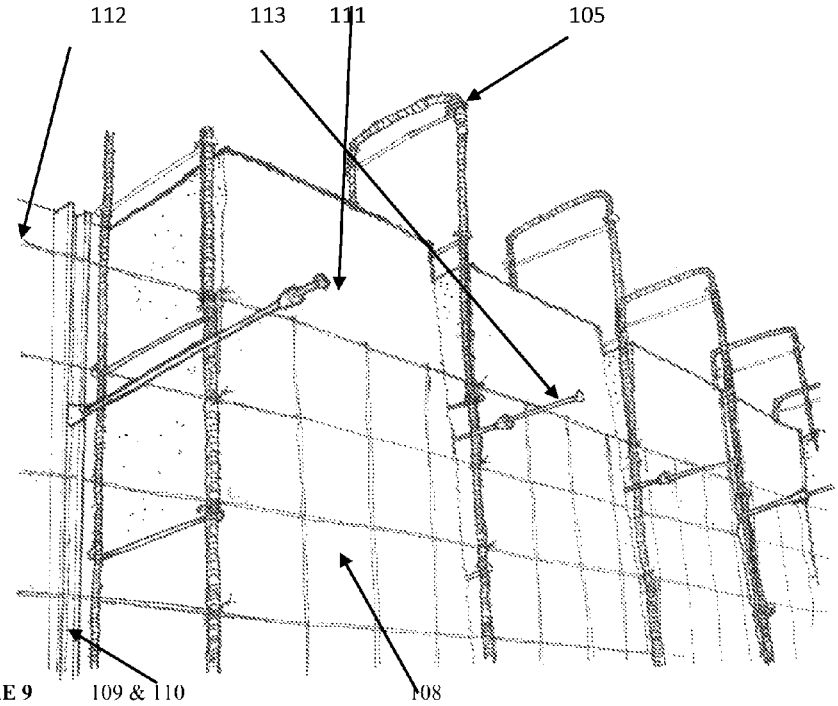
FIG. 9 shows a free hand drawing of the actual wall construction diagrammed in the previous figures.
Figure 10:
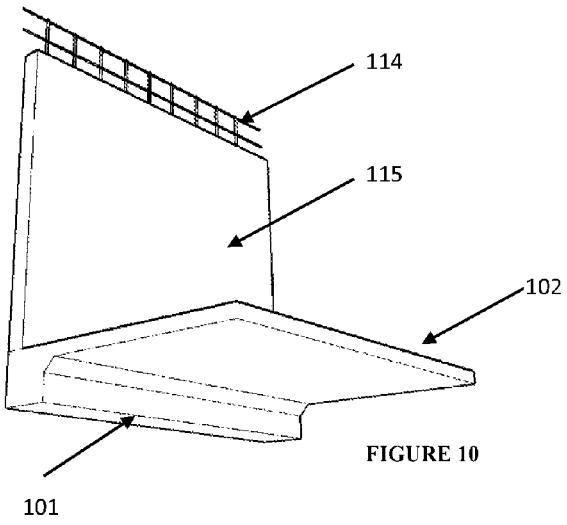
FIG. 10 is a diagram of a flat exterior non-T-beam wall for non livable areas which do not require insulation.
Figure 11:
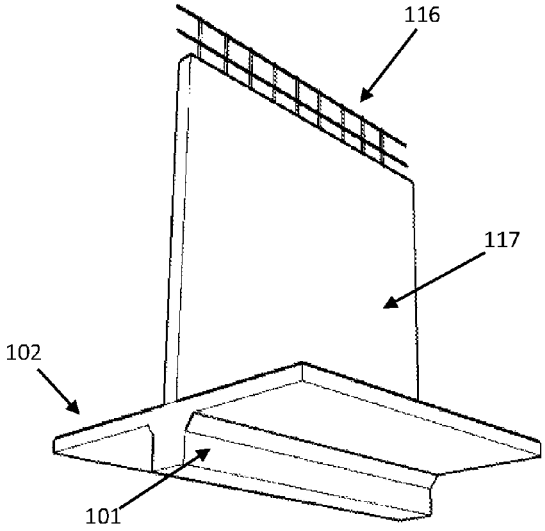
FIG. 11 shows a load bearing non-T-beam partition wall.

FIGS. 9, 10, and 11 continues showing wall types constructed according to an embodiment of the present invention. FIG. 9 is a hand-drawn illustration of the actual T-beam wall construction at a point in the process when one face of the wood forming 112 is in place at the interior face of the wall. In the foreground are the steel reinforcement for stems parts 105 and the continuous vertical and horizontal reinforcement, which in this case comprise wire welded mesh 108 as called for by the structural calculations. The blocks of rigid insulation part 111 are in place. Wall ties part 113 are shown. The following two figures show non-T-beam walls for use where insulation is not required. These walls can be load bearing or non-bearing. FIG. 10 shows a flat wall 115 for exterior non livable areas such as a garage. Footing 101, floor slab 102 and reinforcement 114 are shown. This wall 115 would be attached to the foundation by dowels 104 not visible in the figure. Such dowels were inserted in the footing part prior to the pouring of the foundation as previously shown in FIGS. 2 and 3 FIG. 11 shows a load bearing partition wall 117, reinforced by rebar 116 which is attached to dowels in the footing 101. The sketch also shows the floor slab 102).

Figure 12:
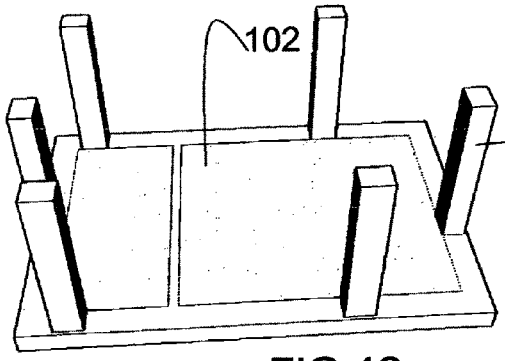
FIG. 12 diagrams a slab with several rigid insulation blocks set in place for walls according to guidelines previously marked on the floor slab.
Figure 13:
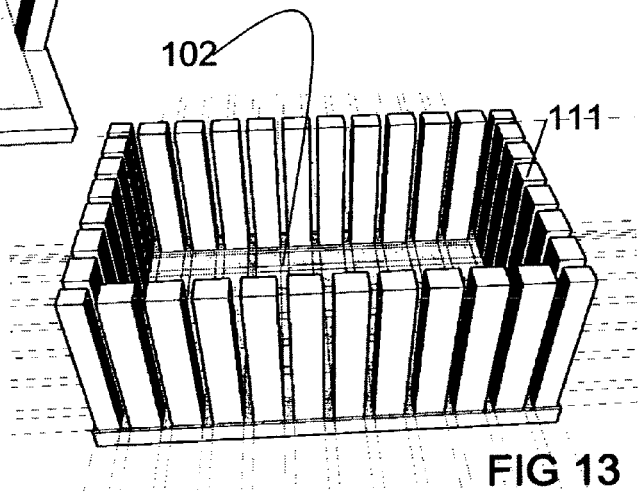
FIG. 13 shows all the blocks of insulation in place.
Figure 14:
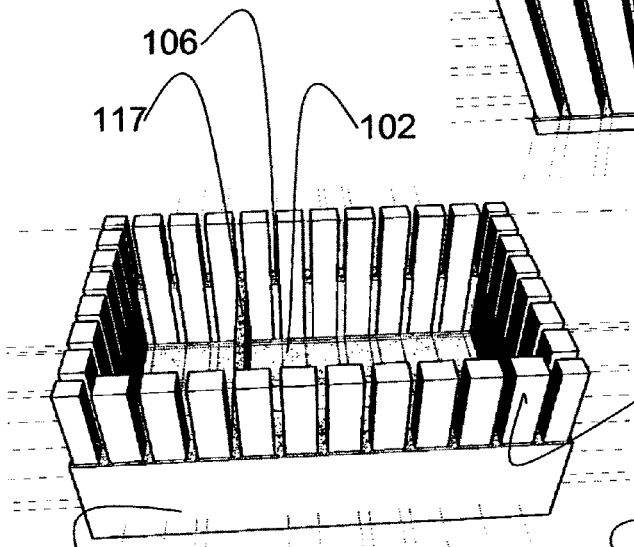
FIG. 14 diagrams concrete walls being poured in between and in back of insulation blocks, as well as a partially poured flat interior wall.
Figure 15:
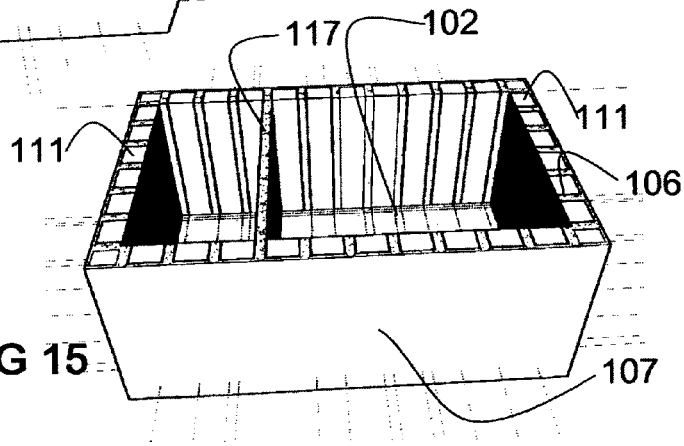
FIG. 15 shows the concrete flanges and stems poured to the height of the walls, and the interior wall at its final height.

FIGS. 12, 13, 14, and 15 show a schematic sequence of T-beam wall construction. Not shown are the form work, reinforcement or openings for doors and windows. In actual construction all those parts are in place before pouring of the concrete. FIG. 12 shows the lines drawn on the floor slab part 102 as guides to set the rigid insulation blocks 111, some of which are shown in place. FIG. 13 shows all the insulation in place. Two lines marked on the floor slab 102 are the place where a load bearing partition wall will be erected. FIG. 14 shows concrete being poured around the insulation blocks. The exterior wall 107 is composed of T-beam flanges and between the blocks are the stems 106. Also a concrete partition wall 117 is being poured. FIG. 15 shows the concrete flanges 107 and stems 106 poured to the height of the walls. The blocks of insulation 111 are now encased by flanges 107 and stems 106.

Figure 16:
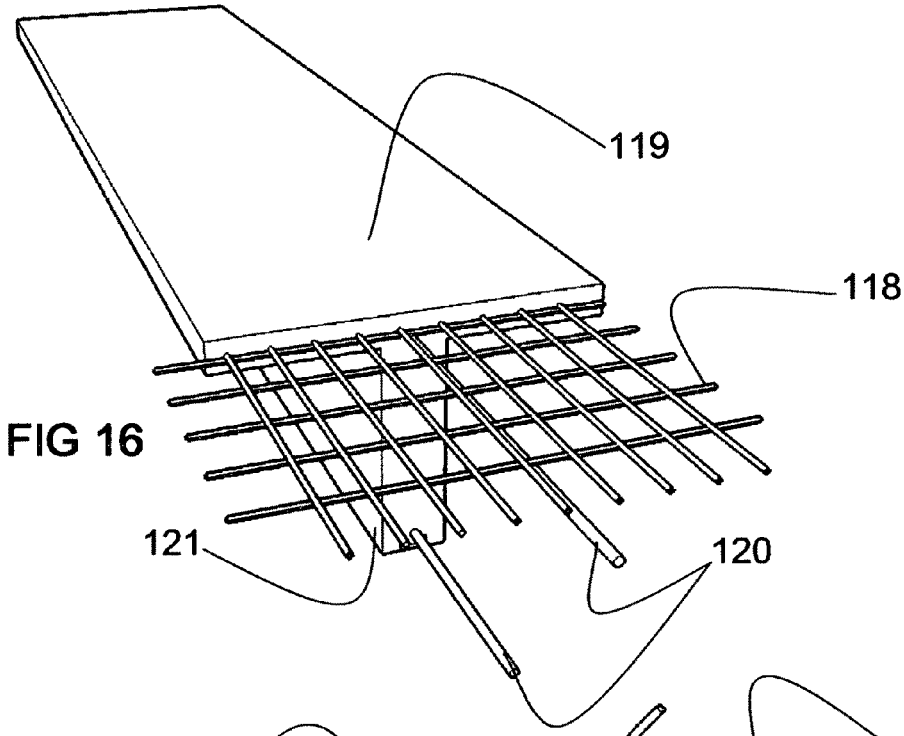
FIG. 16 shows a single T-beam unit for building the roof.
Figure 17:
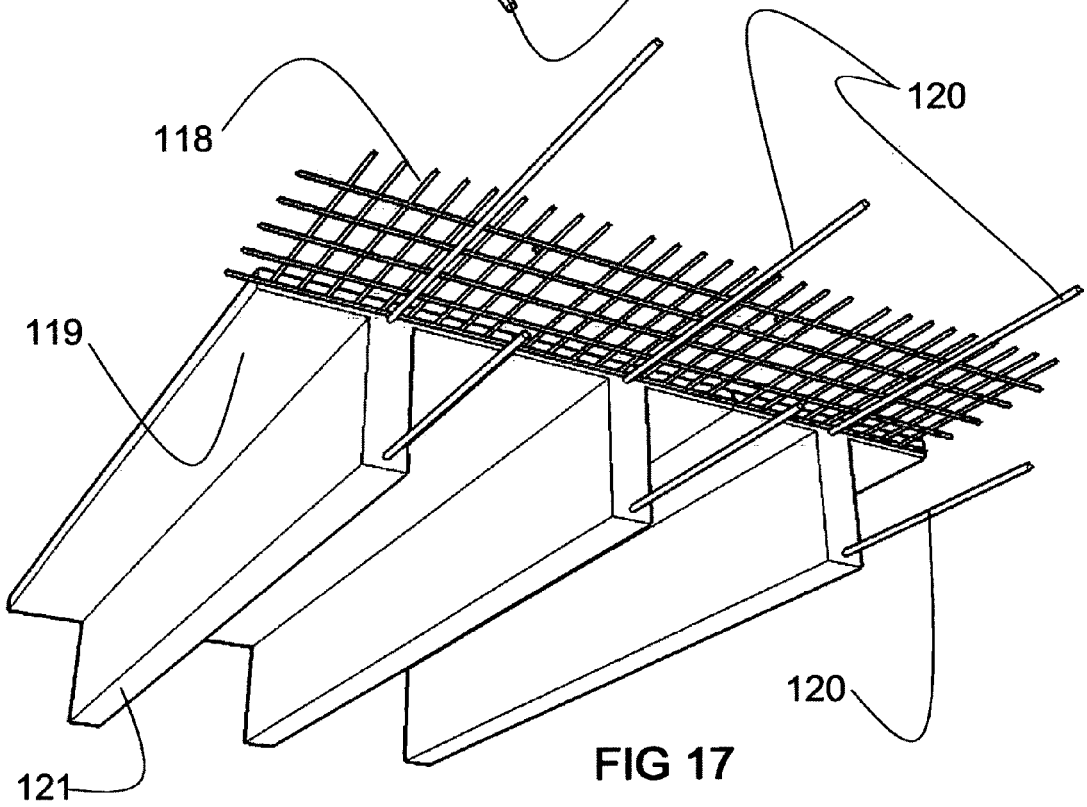
FIG. 17 shows three roof T-beam units together.

FIGS. 16 and 17 illustrate parts of the roof of a monolithic concrete building constructed according to an embodiment of the present invention. FIG. 16 is a sketch of a single T-beam unit for building the root where 118 is the flange reinforcement, 119 is the flange (horizontal portion of the T shape), and the vertical portion of the T is the stem 121 where the upper and lower rebar reinforcements are part 120. These T-beams can be arranged in a horizontal or slanting position, as required by the roof design. They can be cantilevered to create eaves. The options of roof shapes give to the concrete rib system lots of flexibility in design and architectural style. FIG. 17 shows three roof segments together where the T shape of each is clearly defined by the flanges 119. Other numbered parts correspond to those shown in FIG. 16. The flanges when together create the roof slab which when poured with a concrete mixed with additives makes the slab waterproof and self sealing.

Figure 18:
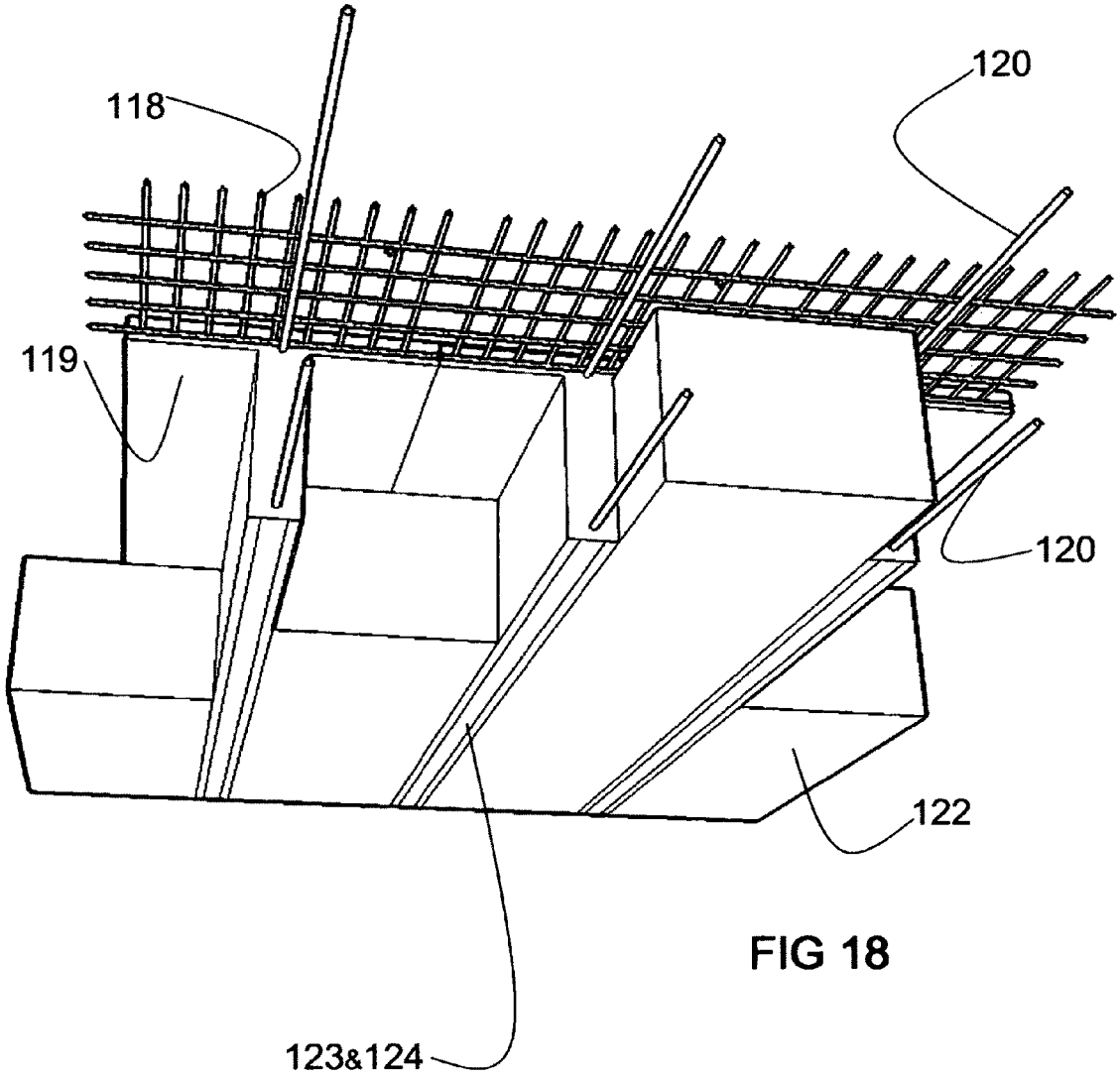
FIG. 18 shows the three T-beam units of FIG. 15 with the blocks of rigid insulation.

FIG. 18 continues illustration of roof construction according to an embodiment of the present invention. FIG. 18 is a cutaway diagram of the three T-beam units of FIG. 17 showing the roof with the embedded blocks of rigid insulation 122.

FIGS. 19 and 20 further illustrate roof construction according to an embodiment of the present invention. FIG. 19 is an illustration of the form work used to build the roof. Conventional adjustable posts 125 support the beams 126, which in turn support the boards 127 forming the lower side of the stems. These boards also support the foam insulation blocks. The innovation is that by using rigid insulation to form the T-beams it is not necessary to cover all the underside of the roof. Only the underside of the stem needs to be supported by the forms. The boards shown in the photo are equal to the width of the stem plus one and a half inches at the sides to hold the insulation blocks in place. This results in labor and material savings as opposed to covering the entire lower surface of the roof. FIG. 20 shows how the roof T-beam stems 106 match with the wall T-beam stems 121 forming a strong joint. This is a novel feature of this invention which makes a strong structure, easy to build and economical because such a joint creates a rigid frame which uses minimal steel reinforcement. In the diagram also labeled are flange roof T-beam reinforcement 118, the concrete flange 119 which becomes a concrete slab rooftop, and roof T-beam reinforcement and 120. Parts 123 and 124 together form nailers on the bottom of the stems of roof T-beams to allow attachment of ceiling furring. These are more fully explained in a subsequent figure. Insulation blocks are omitted in the diagram in order to show the T-beam connections. In practice they are encased by the concrete.

FIG. 21 is an illustration of the actual process of roof construction according to an embodiment of this invention as viewed from above the roof. Boards 127 were used as form work of the roof in this picture. The steel reinforcement of roof stems 120 is shown in between rigid foam blocks 122. FIG. 22 is another illustration of a portion of the roof, viewed from below, supported at one end by an exterior wall 115 in the garage. Foam blocks 122 are shown embedded in the T-beam stems 121. The top of the roof slab 119 is not visible in the picture. The nailers 123 and 124 are in place to be used to attach the gypsum board panels.

Figure 23:
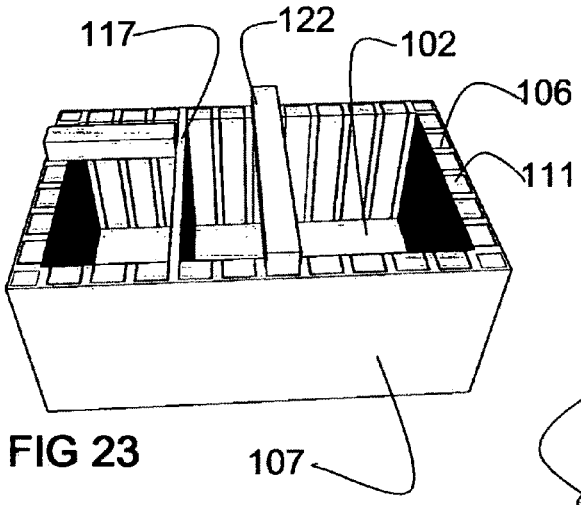
FIG. 23 diagrams the exterior walls built previously with portions of the roof insulation blocks at 90 degrees to one another.
Figure 24:
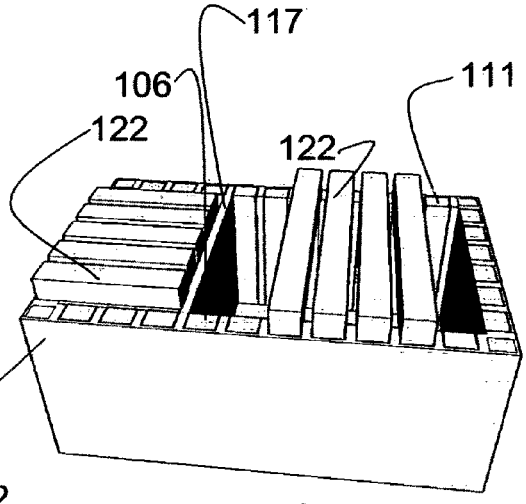
FIG. 24 shows the same view as FIG. 23 with more insulation blocks in place.
Figure 25:
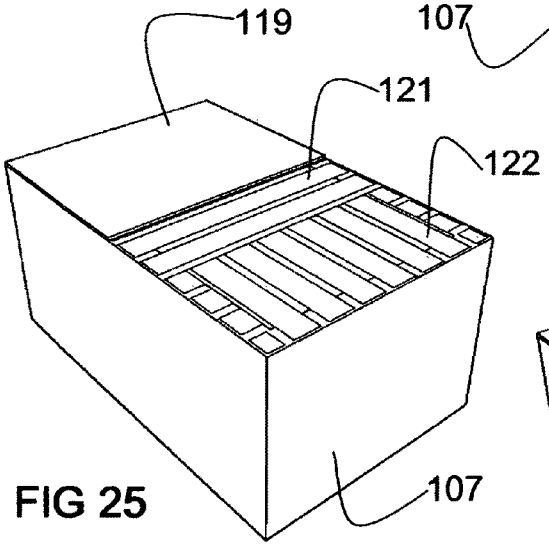
FIG. 25 schematically shows poured concrete covering a portion of the roof.
Figure 26:
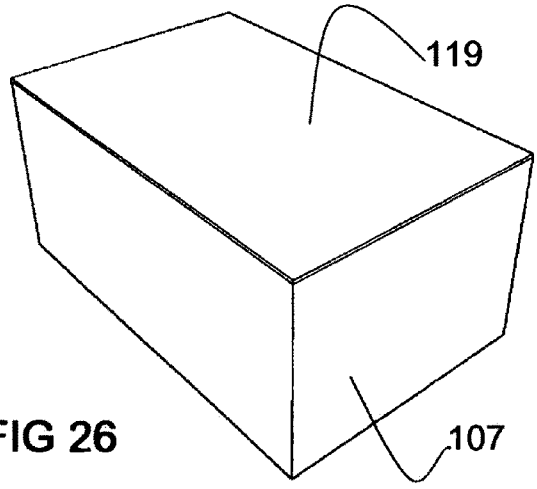
FIG. 26 depicts the rigid concrete box resulting from the method. Note that doors and windows are omitted to simplify the concept.
Figure 27:
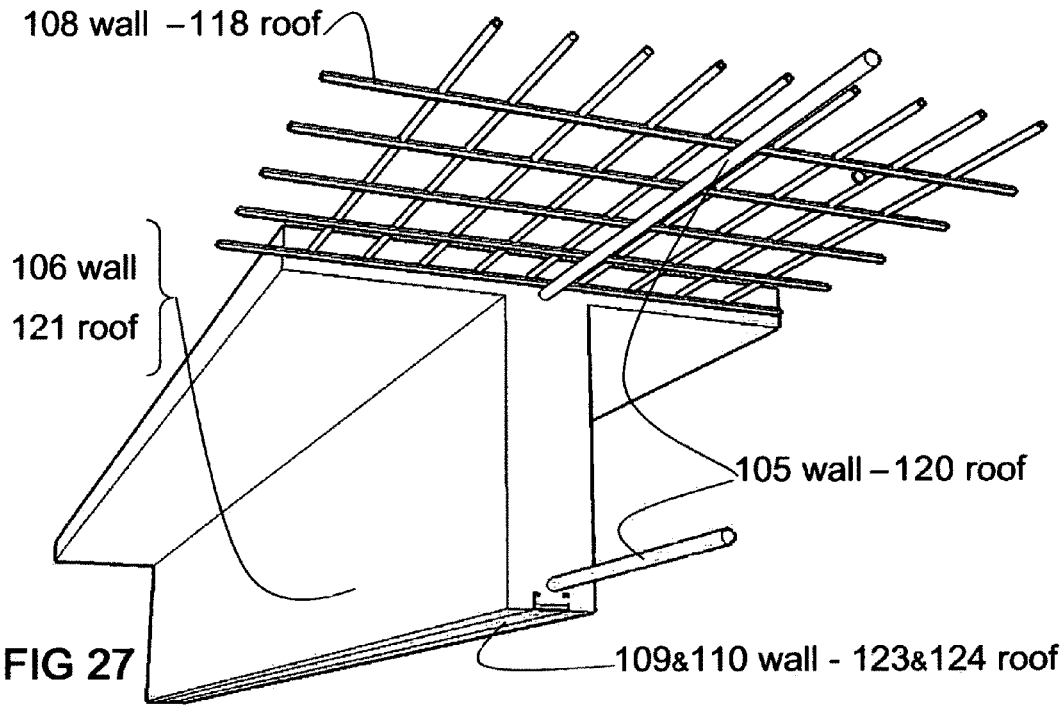
FIG. 27 shows a blow-up of the T-beam used to build exterior walls and roof, showing the stem and flange reinforcements, as well the metal channels embedded by the poured-in concrete.
Figure 28:
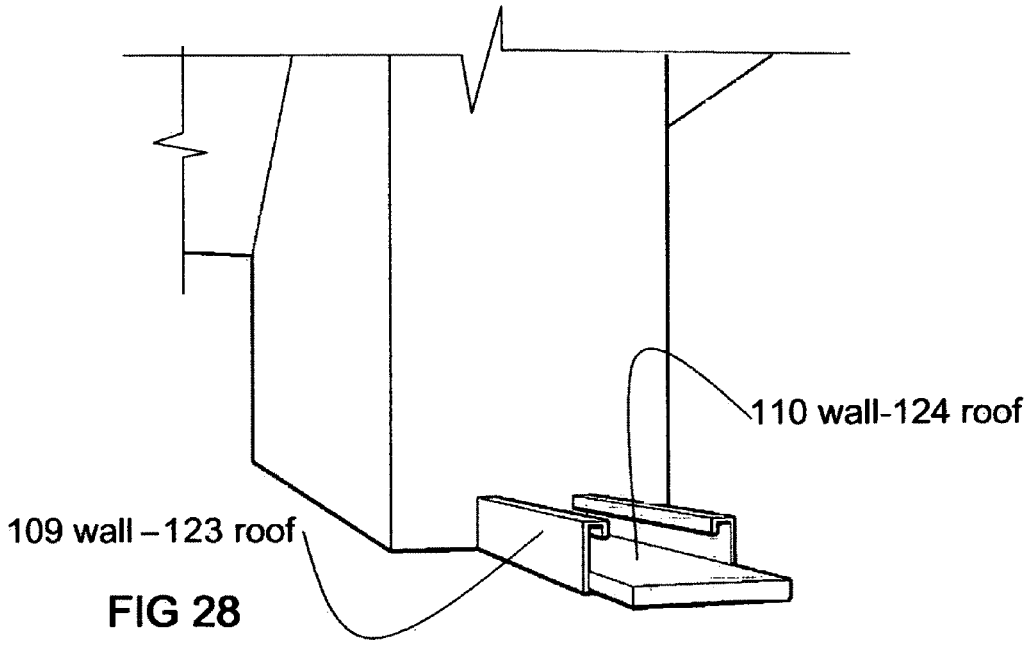
FIG. 28 shows in detail the metal studs with channeled shape with a strip of rigid foam with soft void for attaching screws to attach panels of any material desired by user. Such studs are embedded by concrete into the stem ends of the beams.

FIGS. 23, 24, and 25 illustrate the roof construction process in schematic sequence. FIG. 23 shows the exterior walls built previously with labeled parts 102, 107, 106 and 111, as well as an interior concrete load bearing wall 117. Two blocks of rigid foam 122 have been placed over the walls at right angles to one another. FIG. 24 shows additional blocks 122 in place. FIG. 25 schematically shows a portion of the roof poured with the concrete flanges 119 creating a continuous concrete slab. Note that FIGS. 24 and 25 show the horizontal orientation of the insulation blocks and T-beams with a change in direction. That is, one section of the roof beams will be along a north/south axis while another section will be at a right angle, or east/west axis. This is an important characteristic of the system which results in bracing the structure. The roof T-beam sections set perpendicular to each other confer resistance to hurricanes, tornados and earthquakes. FIG. 26 depicts the monolithic concrete box characteristic of the system. Doors and windows are omitted to simplify the roof construction sketches FIGS. 27 and 28 shows details of the basic T-beam used to build exterior walls and roof. The diagram shows the parts with the same dimensions but in the actual construction they can vary, with different construction specifications, depending on the wall height, beams spans, differing insulation needs for walls or roofs. That is why the parts pictured have different labels. The stem is part 106 for the wall and part 121 for the roof. Stem reinforcement is part 105 for the wall and part 20 for the roof T-beam. The inserts (nailers) to screw furring panels are 109 and 110 for the wall and 123 and 124 for the roof. FIG. 28 shows these inserts in detail. Parts 109/123 is the innovative metal nailer to hold drywall panels, and parts 110/124 is an insert of rigid foam that creates a void when the concrete is poured thereby allowing the builder to easily screw gypsum board or paneling on the walls and ceiling. This is an innovative feature of the invention to deliver the traditional look of home interiors to meet market expectations.

In summary, the T-beam is an effective and economical way to handle spans and structural loads. To create the T shape prior art practice uses intricate forming work which is a costly practice, involving materials and labor to build the molds, time and material for placing them and after their use, removal, clean, repair, managing, and storage. The concrete rib system uses blocks of rigid insulation as forming, which are embedded in the poured-in-place concrete. This saves construction time over conventional methods of forming concrete. This invention avoids extra labor when using the T-beam structural advantages. The novelty of the invention consists of the use of connected T-beams for both walls and roof. The final structure is a monolithic box where the foundation, 101, 102, and 103 is the lower face, walls are the vertical faces of the box, attached to the foundation by dowels 104 to the walls reinforcement part 105 and the roof 118, 119, 120, and 121 is the top. This results in a structure with rigid sturdiness, and integrated high insulation 111 and 122 in walls and roof. In addition to the structural strength, an innovation is the use of metal nailers 123 with the polystyrene foam strip 124 embedded in the ends of the T-beam stems. These milers ease the insertion of screws to wall and ceiling interiors. Thus the building can be easily finished with gypsum board or paneling to meet market expectations.

RAMIFICATIONS

The above description of the concrete rib construction system preferred embodiment does not incorporate dimensions because these will be determined by structural calculations and insulation needs. Generally flange and stem of the beams need to be at least two inches thick in order to accommodate the steel rebar reinforcement. In the construction shown in the accompanying drawings and photographs, the flanges were 2 inches thick and the stems were 4 inches thick. Foam insulation blocks were 14 inches deep and 20 inches wide. The structure was built in the low desert of California where extreme heat is common. Other dimensions could be used in different climates. Dimensions would also vary according to the size of rooms and therefore the length of span of the beams.

The system functions at maximum strength using a central space with one virtual roof beam direction (for example, north to south), and adjacent spaces with roof beams at a perpendicular direction (for example east to west) as illustrated in FIGS. 23 through 25. With this design the building has bracing in all directions making the structure safe for any acting horizontal forces such as wind or earthquakes. Another unobvious feature is that having the flanges of the wall T-beams aligned in the same plane makes them function as a diaphragm plate to resist shear stress. A similar diaphragm plate is created where the roof T-beams are joined together. This makes structures built with this system exceptionally strong. This is one reason I refer to the system as "disaster resistant."

A further variable of the system is that the rigid foam insulation, Expanded Polystyrene Foam or EPS, has an R value of 4 per inch (for one pound density foam; greater density equals higher R value if required). My experience building with the system has found 14 inch thickness practical to use. This gives an R value of 56, which is far superior to a conventional wood framed building meeting the building code requirements of a minimum 13 R-value for walls and 19 for roof.

The EPS Expanded polystyrene foam, parts 11 or 22 have a flame spread of less than 25 and a smoke-developed index of less than 450, which means they can be used without a fire barrier. As previously stated, the concrete rib construction system provides a minimum of two inches at walls and roof. The minimum 2 inch thick flange creates a 4 hour fire protection to the EPS rigid insulation, greater than the required 15 minute thermal barrier, according to US building codes, Table 7-A. While a particular commercial product was used in this example, various types of rigid foam products could function as forms for the concrete.

In a similar manner, the specifications for the concrete mixture can vary. Some parts of the building photographed were built with 3000 PSI concrete, which hardens reaching its PSI factor very quickly, because we wished to remove the forms the following day. However, concrete specifications can vary according to the available time, budget and suppliers. Concrete mixing technology allows walls and roofs to be constructed with any desired strength in pounds per square inch. Additives can make the concrete white to reflect suns rays for energy efficiency. There are also additives making concrete capable of self repair cracks up to 4 millimeters and giving waterproof qualities. Fiber glass addition in the mix improves its resistant to flexion stress. Additives can allow the mix to be poured underwater. Thus the Concrete Rib Construction System is applicable to a wide spectrum of building solutions.

Although the diagrams incorporate the simplest of geometric forms, it is clear that buildings have different shapes, architectural styles, décor, and textures. The concrete rib construction system, with poured-in-place concrete, can incorporate customized additions to the form work to create any form or style of ornamentation; concrete takes whatever the mold contains.

The invention claimed is:

1. A method of constructing a well-insulated rigid monolithic concrete building using a plurality of T-beams with vertical stem portions and cross-sectional flange portions, said method comprising the steps of:

arranging a plurality of rebars in a vertical arrangement on a foundation;

anchoring the rebars onto the foundation with anchoring elements to form a frame for the walls of the building;

arranging forms in a vertical arrangement;

embedding rigid foam insulation material in between the rebars;

arranging a plurality of reinforcement bars at an angle from the plurality of rebars to form the frame for the roof of the building;

connecting the plurality of rebars and the plurality of reinforcement bars with connecting elements;

arranging forms in the bottom portion of the frame for the roof;

pouring in a concrete mixture to fill voids around the plurality of rebars, forms, and the rigid foam insulation material thereby forming T-beams with vertical stem portions and cross-sectional flange portions to form the walls; and pouring in a concrete mixture to fill voids around the plurality of reinforcement bars and forms thereby forming T-beams with vertical stem portions and cross-sectional flange portions to form the roof.

2. The method of claim 1 wherein the forms comprise plywood.

3. The method of claim 1 wherein the rigid foam insulation material comprises expanded polystyrene foam blocks.

4. The method of claim 1 further comprising:

a step of attaching a plurality of metal channels with anterior and posterior portions to the forms with nailers so that the anterior portions of the metal channels face the interior of the building and the posterior portions of the metal channels become embedded in the stem portions of the T-beams forming the walls and the roof once the concrete is poured.

5. The method of claim 4 wherein the posterior portion of the metal channel embedded into the stem portion of each T-beam includes an expanded polystyrene foam backing.

6. The method of claim 1 wherein the anchoring elements for connecting the plurality of rebars to the foundation comprise steel dowels.

7. The method of claim 1 wherein the connecting elements for connecting the rebars forming the frame for the walls with the reinforcement bars forming the frame for the roof comprise steel rebar reinforcements.

8. The method of claim 1 further comprising a step of creating openings in the arrangement of T-beams forming the walls to form windows and doors.

9. The method of claim 1 wherein the plurality of reinforcement bars forming the frame for the roof of the building are arranged in a horizontal position.

10. The method of claim 4 further comprising the steps of:

attaching a finish wall surface onto the plurality of metal channels embedded into the stem portions of the T-beams forming the walls; and attaching a finish ceiling surface onto the plurality of metal channels embedded into the stem portions of the T-beams forming the roof.

11. The method of claim 1 wherein the plurality of reinforcement bars forming the frame for the roof of the building are arranged in a perpendicular direction from the plurality of rebars forming the frame for the walls of the building.

12. The method of claim 1 wherein the cross-sectional flange portion of each T-beam is at least two inches thick.

13. The method of claim 1 wherein the stem portion of each T-beam is at least four inches thick.

14. The method of claim 1 wherein the concrete mixture comprises 3000 PSI concrete.

15. The method of claim 1 wherein the rigid foam insulation material becomes integrated within the concrete walls of the building after the concrete mixture is poured around the plurality of rebars and the rigid foam insulation materials forming the walls.

16. The method of claim 1 further comprising a step of removing the forms after the concrete mixture is poured.

17. The method of claim 4 further comprising a step of attaching a dry wall panel onto the plurality of metal channels embedded into the stem portions of the T-beams forming the walls.

* * * * *